US007619361B2

(12) United States Patent
Hirohashi et al.

(10) Patent No.: US 7,619,361 B2
(45) Date of Patent: Nov. 17, 2009

(54) DISCHARGE LAMP DEVICE INCLUDING AN AIRTIGHT CONTAINER FILLED WITH A NOBLE GAS

(75) Inventors: Masaki Hirohashi, Kyoto (JP); Nobuhiro Shimizu, Nara (JP); Norikazu Yamamoto, Kyoto (JP); Teruaki Shigeta, Osaka (JP); Yoko Matsubayashi, Nara (JP); Yutaka Wakimura, Kyoto (JP); Shuuji Furukawa, Kyoto (JP); Hisashi Dejima, Kyoto (JP)

(73) Assignee: Panasonic Corporation, Osaka (JP)

( * ) Notice: Subject to any disclaimer, the term of this patent is extended or adjusted under 35 U.S.C. 154(b) by 255 days.

(21) Appl. No.: 10/585,927

(22) PCT Filed: Jan. 5, 2005

(86) PCT No.: PCT/JP2005/000005

§ 371 (c)(1),
(2), (4) Date: Jul. 13, 2006

(87) PCT Pub. No.: WO2005/069351

PCT Pub. Date: Jul. 28, 2005

(65) Prior Publication Data

US 2008/0061699 A1 Mar. 13, 2008

(30) Foreign Application Priority Data

Jan. 14, 2004 (JP) ..... 2004-006596

(51) Int. Cl.
*H01J 11/00* (2006.01)

(52) U.S. Cl. ..... 313/607; 313/234; 313/238; 313/637; 313/485; 362/225; 362/560

(58) Field of Classification Search ..... 313/637, 313/234, 607
See application file for complete search history.

(56) References Cited

U.S. PATENT DOCUMENTS 5,514,934 A * 5/1996 Matsumoto et al. ..... 313/607
5,869,931 A * 2/1999 Terada ..... 313/607

(Continued)

FOREIGN PATENT DOCUMENTS

EP 948030 A2 * 10/1999
JP 5-29085 A 2/1993

(Continued)

OTHER PUBLICATIONS

Machine English translation of JP 5190150 to Hoshizaki.*
Chinese Office Action issued in Chinese Patent Application No. CN 2005800024768 dated Mar. 6, 2009.

*Primary Examiner*—Sikha Roy
(74) *Attorney, Agent, or Firm*—McDermott Will & Emery LLP

(57) ABSTRACT

A discharge lamp device is provided that includes a light source device including a reflective surface. In the light source, noble gas not including mercury is excited to provide stable light emission and ozone or the like is prevented from being generated. This discharge lamp device includes airtight container (10) in which both end sections of a glass bulb are sealed. Airtight container (10) is filled with a discharge medium mainly including noble gas. One end section of airtight container (10) includes first electrode (11). Airtight container (10) is externally attached to insulating holder (20) having a square plate-like shape that includes penetration hole(s) (21) at one or a plurality of position(s). Holder (20) is fitted to second electrode (12) shaped to be a U-like groove so that a fixed interval between airtight container (10) and second electrode (12) is maintained. Three side faces (22) of holder (20) include protrusion (23) and second electrode (12) includes fitting hole (15) fitted with protrusion (23). By fitting protrusion (23) with fitting hole (15), holder (20) is prevented from disengaged from second electrode (12).

17 Claims, 7 Drawing Sheets

U.S. PATENT DOCUMENTS

| | | | | |
|---|---|---|---|---|
| 6,194,821 | B1 | 2/2001 | Nakamura | |
| 6,331,064 | B1 | 12/2001 | Nishiyama et al. | |
| 6,796,678 | B2 * | 9/2004 | Moon | 362/225 |
| 7,276,851 | B2 * | 10/2007 | Tanabe et al. | 313/607 |
| 2001/0050735 | A1 | 12/2001 | Yajima et al. | |
| 2002/0027774 | A1 | 3/2002 | Nishiyama et al. | |
| 2003/0052611 | A1 | 3/2003 | Yamamoto et al. | |
| 2005/0253520 | A1 * | 11/2005 | Tanabe et al. | 313/607 |
| 2006/0139934 | A1 * | 6/2006 | Hirohashi et al. | 362/362 |

FOREIGN PATENT DOCUMENTS

| | | | |
|---|---|---|---|
| JP | 5-190150 | A | 7/1993 |
| JP | 10-64478 | A | 3/1998 |
| JP | 10-112290 | A | 4/1998 |
| JP | 10-188908 | A | 7/1998 |
| JP | 11-329365 | A | 11/1999 |
| JP | 2000-162593 | A | 6/2000 |
| JP | 2000-277056 | A | 10/2000 |
| JP | 2000285867 | A * | 10/2000 |
| JP | 2001-196028 | A | 7/2001 |
| JP | 2001-325919 | A | 11/2001 |
| JP | 2002-82327 | A | 3/2002 |
| JP | 2002-093589 | | 3/2002 |
| JP | 2002-184360 | A | 6/2002 |
| JP | 2003-178717 | A | 6/2003 |
| JP | 2003-317669 | A | 11/2003 |

* cited by examiner

DISCHARGE LAMP DEVICE INCLUDING AN AIRTIGHT CONTAINER FILLED WITH A NOBLE GAS

RELATED APPLICATIONS

This application is the U.S. National Phase under 35 U.S.C. § 371 of International Application No. PCT/JP2005/000005, filed on Jan. 5, 2005, which in turn claims the benefit of Japanese Application No. 2004-006596, filed on Jan. 14, 2004, the disclosures of which Applications are incorporated by reference herein.

TECHNICAL FIELD

The present invention relates to a discharge lamp device that includes a light source device having an airtight container filled with a discharge medium, a pair of electrodes or the like and a reflective surface. In particular, the present invention relates to a discharge lamp device in which an airtight container is filled with noble gas not including mercury.

BACKGROUND ART

A backlight used for a liquid crystal display for example is composed of a light guide plate, a discharge lamp device or the like and the discharge lamp device is composed of a light source device and a reflection member. A conventional light source device is structured such that an end of an opening of a glass bulb in which a fluorescent material layer is layered on an inner periphery is sealed with electrodes via a bead glass. In the glass bulb, mixed gas of neon and argon and mercury are diffused and filled in an appropriate amount, respectively. This light source device works in a manner as described below. Specifically, when a voltage is applied between the electrodes to ionize and excite the mixed gas and mercury in the glass bulb, ultraviolet is generated. This ultraviolet is converted to visible light by the fluorescent material layer. This visible light passes through the glass bulb and is emitted to outside, thereby providing light emission.

However, the above light source device using mercury is highly dependent on a temperature and thus has a poor luminous flux startup characteristic at a low temperature and is not desirable from a viewpoint of environmental protection. Thus, such a light source device that does not use mercury has been desired.

In view of the above, such a light source device that uses noble gas instead of mercury has been disclosed by Japanese Patent Unexamined Publication No. H5-29085, Japanese Patent Unexamined Publication No. H10-112290, and Japanese Patent Unexamined Publication No. 2001-325919.

A light source device disclosed by Japanese Patent Unexamined Publication No. H5-29085 has a structure as described below. Specifically, a fluorescent material layer is formed on an inner circumference face of a glass bulb in which both end sections are sealed. This glass bulb is filled with inert gas consisting of xenon or mainly including xenon. One end section of the glass bulb includes an inner electrode and almost the entire length of an outer face of the glass bulb is joined with an outer electrode having a stripe shape. The inner electrode and the outer electrode of the light source device as described above are connected with a high-frequency lighting circuit to which a high-frequency voltage is applied. This high-frequency lighting circuit is designed so that an effective value of current flowing from the inner electrode to the outer electrode is smaller than an effective value of current flowing from the outer electrode to the inner electrode to reduce a rate at which noble gas ion is implanted to a glass wall of the glass bulb so that the noble gas is prevented from being lost.

A light source device disclosed by Japanese Patent Unexamined Publication No. H10-112290 has a structure as described below. A glass bulb filled with noble gas such as xenon have both end sections at which inner electrodes having an identical polarity are provided. An outer circumference face of the glass bulb is wound with a linear outer electrode whose polarity is different from that of the inner electrodes. This light source device emits ultraviolet that reacts with light oxygen in air existing around the light to generate ionized gas molecules having an bacteriostatic action (e.g., ozone).

Furthermore, a light source device disclosed by Japanese Patent Unexamined Publication No. 2001-325919 has a structure as described below. A long and thin and translucent airtight container is provided in which both end sections of a glass bulb are sealed so that the interior works as a discharge space. This airtight container is filled with discharge medium mainly including noble gas and is sealed to include therein one or a plurality of inner electrode(s). An outer surface of the glass bulb is almost in contact with an outer electrode and the outer electrode and the discharge space have therebetween a capacitance change means. The capacitance change means changes the distribution of impedance between the outer electrode and the discharge space so that uniformly or desirably changed light intensity distribution can be obtained along the longitudinal direction of the airtight container.

However, the light source devices introduced by the above publications find difficulty in completely sealing an outer electrode to a glass bulb and thus a small space is caused. The status as described above not only causes a light source device to emit light in a very unstable manner but also causes air in this small space to induce dielectric breakdown. This causes a problem where ionized gas molecules (e.g., ozone) for example break the outer electrode or the glass bulb.

Furthermore, even when the light source devices introduced by the above publications are manufactured so that a clearance is prevented from being caused between an outer electrode and a glass bulb by mechanically abutting the outer electrode to the glass bulb or by adhesive agent, an evaporation method, or a sputter technique, the adhesion status therebetween is unstable due to a manufacturing error, vibration during the operation, or an environmental change (e.g., temperature change) for example. As a result, a space is partially caused therebetween.

In view of the above, it is an objective of the present invention to provide a discharge lamp device including such a light source device that prevents ozone for example from being caused between an airtight container filled with noble gas and an outer electrode to prevent dielectric breakdown and that includes a reflective surface.

SUMMARY OF THE INVENTION

The discharge lamp device according to the present invention includes: an airtight container filled with a discharge medium mainly including noble gas; a first electrode provided in the airtight container; a second electrode that includes an opening through which light emitted from the airtight container is emitted, that is provided to have a predetermined interval to the airtight container, and that includes a reflective surface; and an insulating holder that is externally attached to the airtight container and that maintains the predetermined interval.

Here, the predetermined interval is set to be sufficiently larger than a small clearance between an airtight container and a second electrode in a conventional example. Tests have proved that the interval as described above prevents the air-induced dielectric breakdown. The second electrode may be shaped to be a groove having a U-like, C-like, or V-like cross section for example so that the groove can receive the holder. Alternatively, the second electrode also may have a plate-like shape that is adhered to the holder. The discharge medium is one or more type(s) of gas mainly including noble gas and may include mercury.

According to this discharge lamp device, the holder functions as a spacer provided between the airtight container and the second electrode. The holder allows the second electrode to be located at a position having a predetermined distance to the airtight container. This maintains a fixed interval between the second electrode and the airtight container to prevent ozone or the like from being caused between the second electrode and the airtight container. Thus, stable light emission can be provided without dielectric breakdown. Furthermore, the second electrode has the reflective surface. Thus, this discharge lamp device does not require additional reflection plate and thus can have smaller size and reduced cost.

In the discharge lamp device, it is preferable that the holder includes a penetration hole to which the airtight container is inserted and includes a protrusion at a position at which the second electrode is provided; and the second electrode includes a fitting hole fitted with the protrusion of the holder. According to this discharge lamp device, the second electrode includes the holder that is provided at one or two ore more position(s). The airtight container is inserted to the penetration hole of the holder and is retained. The second electrode includes the fitting hole. A side face of the holder includes the protrusion. By fitting this fitting hole with the protrusion, the holder is prevented from being disengaged from the second electrode or from being displaced. Thus, a fixed interval between the airtight container and the second electrode is maintained.

In the discharge lamp device of the present invention, it is preferable that a relation between a length a of the holder in a direction along which the airtight container is inserted and a length b of the protrusion in the insertion direction is determined to be a>b. When a user holds a liquid crystal display using the discharge lamp device of the present invention as a backlight by hands, a risk may be caused where the discharge lamp device receives pressure from a side to deform the holder and thus a distance between the airtight container and the second electrode is changed.

Another risk may be caused where dust may come into the second electrode via a clearance between the protrusion and the fitting hole formed in the second electrode. According to this discharge lamp device, the holder has an improved rigidity. Thus, even when the discharge lamp device receives the pressure as described above, the deformation of the holder can be minimized. This can maintain a fixed distance between the airtight container and the second electrode. Furthermore, the side face completely sealing the fitting hole can prevent dust from coming into the second electrode.

In the discharge lamp device, it is preferable that a length a of the holder in a direction along which the airtight container is inserted is determined such that a relation between length $a_1$ at a side from which the airtight container emits light and length $a_2$ at a side at which the second electrode is provided is $a_1<a_2$. According to this discharge lamp device, the size of the holder in a direction along which the airtight container is inserted is determined such that the thickness of the holder is increased toward a side at which the second electrode is provided and is reduced in a direction along which light is emitted from the airtight container. This can increase the rigidity of the holder while securing the light intensity of the discharge lamp device.

In the discharge lamp device, the holder may be made of transparent material and may be formed to have the same length as that of the airtight container. In this discharge lamp device, the holder retains the airtight container for almost the entire length. As a result, a fixed interval between the airtight container and the second electrode is maintained accurately.

In the discharge lamp device, the second electrode may be buried in the holder to have a predetermined interval to the airtight container. According to this discharge lamp device, the second electrode buried in the holder securely maintains an interval between the second electrode and the airtight container. The buried second electrode may have an arbitrary shape such as a flat plate-like shape, a groove-like cross section, one or a plurality of bar-like shape(s), or a stripe-like shape.

Another discharge lamp device according to the present invention includes: an airtight container filled with a discharge medium mainly including noble gas; a first electrode provided in the airtight container; a second electrode buried in the holder to have a predetermined interval to the airtight container; an insulating holder that is made of transparent material to have the same length as a length of the airtight container and that includes a penetration hole to which the airtight container is inserted; and a reflection member that includes an opening through which light emitted from the airtight container is emitted and that is externally provided to the second electrode.

According to this discharge lamp device, the second electrode buried in the holder maintains a fixed interval between the second electrode and the airtight container as in the above-described discharge lamp device. This prevents ozone or the like from being generated between the second electrode and the airtight container and thus stable light emission can be provided without causing dielectric breakdown. Furthermore, the reflection member externally provided to the second electrode can reduce the interval between the second electrode and the airtight container and can increase the interval between the airtight container and the reflection member.

The second electrode may be, for example, a transparent electrode mainly including tin oxide, indium oxide or the like. This prevents light emitted from the airtight container from being blocked by the second electrode.

In the discharge lamp device, the holders may be arranged to be parallel to one another and corners at a side at which light emitted from the airtight container is emitted are joined. According to this discharge lamp device, when a plurality of discharge lamp devices are arranged on a back face of the light guide plate, an assembly operation can be simplified. A plurality of holders may be integrally formed with the linkage member or the former may be separately provided from the latter.

In the discharge lamp device, the holder may include an empty section that is provided at a side at which light emitted from the airtight container is emitted and that has a width smaller than an outer diameter of the airtight container. According to this discharge lamp device, the holder including the empty section can improve the assembly operation by fitting the airtight container via this empty section into the penetration hole. The airtight container fitted in the holder has an outer diameter smaller than the width of the empty section. Thus, the airtight container is prevented from being disengaged from the penetration hole.

In the discharge lamp device, it is preferable that the predetermined interval is in a range from 0.1 mm to 2.0 mm at the shortest. According to this discharge lamp device, the shortest distance of 0.1 mm or more is sufficiently larger than a small clearance between an airtight container and the second electrode in a conventional example. This can prevent ozone from being generated. Furthermore, the shortest distance of 2.0 mm or less can sufficiently excite the discharge medium in the airtight container when the maximum voltage of 5 kV is applied between the first electrode and the second electrode.

In the discharge lamp device, it is preferable that the discharge medium includes at least xenon gas and a fluorescent material layer is layered on an inner circumference of the airtight container. According to this discharge lamp device, xenon gas is excited to generate ultraviolet. This ultraviolet is converted to visible light by the fluorescent material layer.

According to the above discharge lamp device according to the present invention, the airtight container that is filled with a discharge medium mainly including noble gas and that includes the first electrode is externally attached with the insulating holder and this holder includes the second electrode. This can maintain a predetermined interval between the airtight container and the second electrode. This can prevent the airtight container and the second electrode from having a part at which they are abutted to each other or a clearance therebetween. Thus, ozone for example can be prevented from being generated. Thus, the airtight container is prevented from being broken and thus the discharge lamp device can have a longer life.

Furthermore, the second electrode including the reflective surface allows the discharge lamp device to have smaller size and smaller cost. Thus, a liquid crystal display including this discharge lamp device for example also can have smaller size and smaller cost.

REFERENCE MARKS IN THE DRAWINGS

Figure 1:
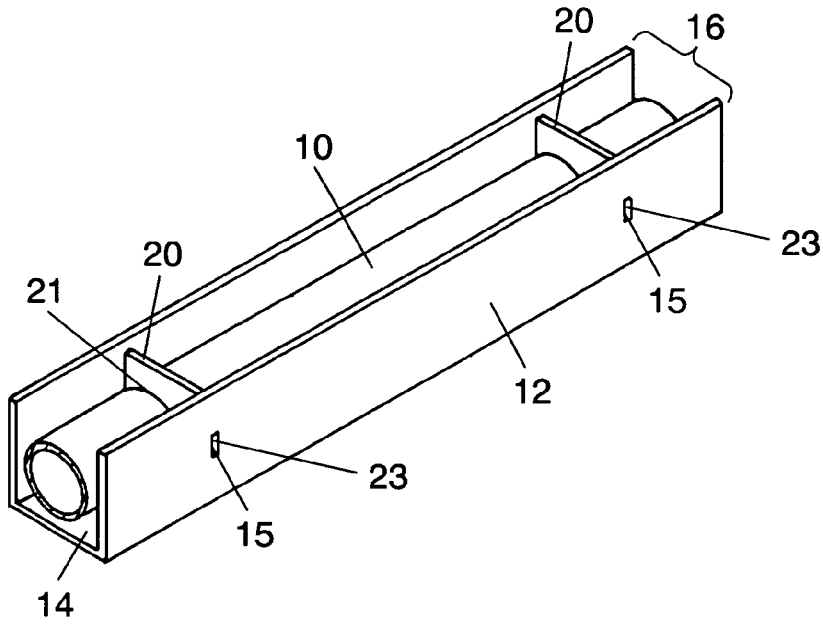
FIG. 1 is a perspective view illustrating Embodiment 1 of a discharge lamp device according to the present invention.

10 Airtight container
11 First electrode
12 Second electrode
13 Fluorescent material layer
14 Reflective surface
15 Fitting hole
20 Holder
21 Penetration hole
22 Side face
23 Protrusion
24 Empty section
30 Reflection member

DETAILED DESCRIPTION OF PREFERRED EMBODIMENTS

Embodiment 1

Embodiment 1 of a discharge lamp device according to the present invention will be described with reference to FIG. 1 to FIG. 6. The discharge lamp device according to Embodiment 1 includes airtight container 10 in which both end sections of a glass bulb (not shown) are sealed. The interior of airtight container 10 is filled with discharge medium mainly including noble gas. One end section or both end sections of airtight container 10 include(s) first electrode 11. Insulating holder 2 is externally attached to airtight container 10 at one or a plurality position(s) of airtight container 10 (two positions in FIG. 1). Holder 20 is attached with second electrode 12.

Airtight container 10 is made of material such as glass (borosilicate glass, silica glass, soda glass, lead glass), organic matter (e.g., acryl), or other translucent materials. Airtight container 10 basically has a straight pipe-like shape but also may have an L-like shape, a U-like shape, or a rectangular shape. Airtight container 10 basically has a circular cross section but also may have a different cross section such as an oval, triangular, or square cross section. Airtight container 10 generally has an outer diameter from 1.0 mm to 10 mm but also may have an outer diameter of about 30 mm. Airtight container 10 has a thickness of about 0.1 mm to 1.0 mm.

Airtight container 10 as described above is filled with a discharge medium (not shown). The discharge medium is composed of noble gas such as xenon, neon, argon, or krypton and also may be composed of noble gas including mercury. The pressure of gas filled in airtight container 10 (i.e., pressure in airtight container 10) is about 0.1 kPa to 76 kPa.

When noble gas such as xenon generates ultraviolet by discharge, an inner circumference of airtight container 10 is layered with fluorescent material layer 13 for converting ultraviolet to visible light. Fluorescent material layer 13 is made of material such as the one for a fluorescent lamp for general lighting or a plasma display for example. However, material of fluorescent material layer 13 also may be changed so that light other than white light (e.g., red, green, or blue light) can be generated.

First electrode 11 is made of metal such as tungsten or nickel for example and the surface is partially or entirely covered by a metal oxide layer such as the one composed of cesium oxide, barium monoxide, or strontium oxide. The metal oxide layer as described above can reduce a lighting starting voltage and can prevent deterioration of an electrode due to ion collision. The first electrode as described above is connected with a lead wire (not shown) connected to a lighting circuit (not shown).

Figure 2:
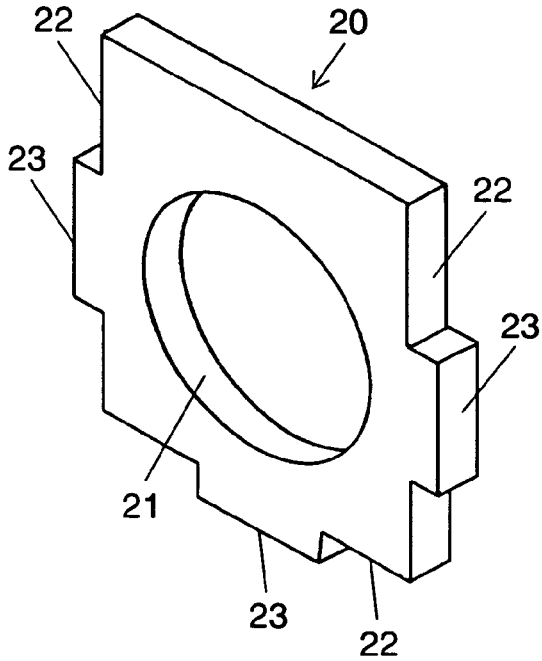
FIG. 2 is a perspective view illustrating Embodiment 1 of a holder constituting the discharge lamp device according to the present invention.

Holder 20 has a square plate-like shape as shown in FIG. 2 that includes penetration hole 21 to which airtight container 10 is inserted. Three side faces 22 have protrusions 23, respectively. Protrusion 23 is not limited to the shown rectangular parallelepiped-like shape and also may be formed by one or two or more cylindrical shape(s). Holder 20 as described above is made of material having insulation, transparency, and elasticity such as silicon resin or silicon rubber.

Second electrode 12 includes opening 16 for emitting light emitted from airtight container 10 and is formed to have a U-like groove that surrounds airtight container 10 by the three sides and that has the same length as that of airtight container 10. Airtight container 10 is opposed to reflective surface (reflector) 14. Second electrode 12 is made of metal having superior light reflectivity such as copper, aluminum, or stainless so that second electrode 12 can entirely work as reflective surface 14.

Figure 3:
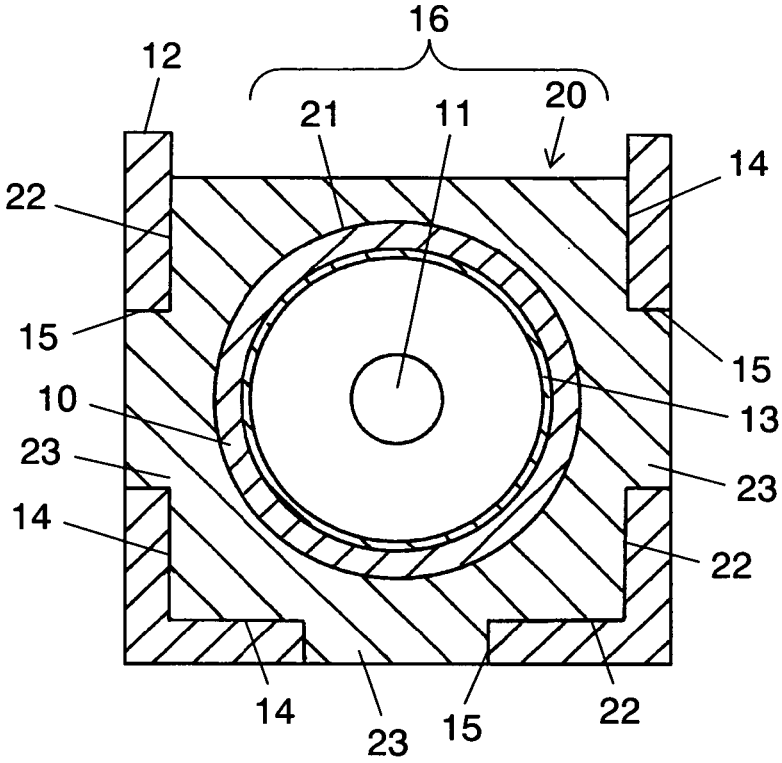
FIG. 3 is a cross-sectional view illustrating Embodiment 1 of the discharge lamp device according to the present invention.
Figure 4:
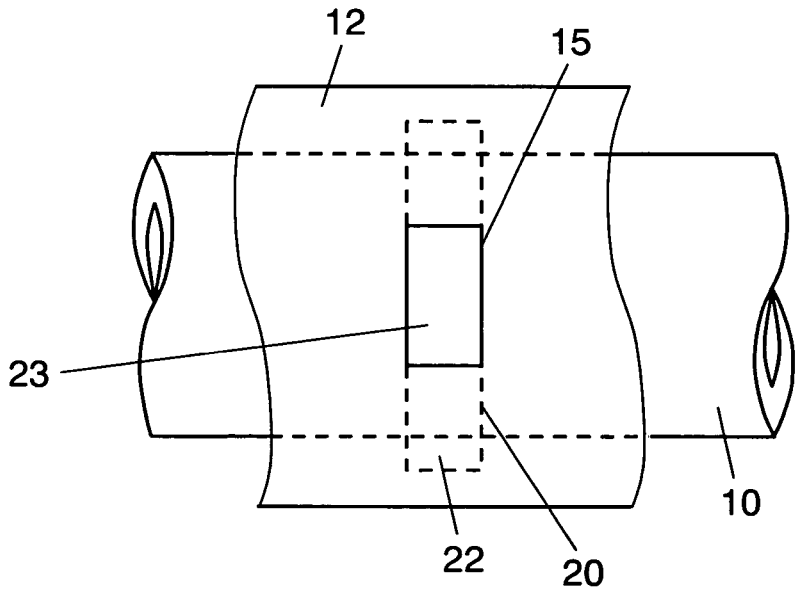
FIG. 4 is a front view illustrating the main part of Embodiment 1 the discharge lamp device according to the present invention.

Holder 20 is fitted with one or two or more part(s) of second electrode 12 (two positions in FIG. 1). Specifically, second electrode 12 includes fitting holes 15 that are provided at positions at which holder 20 is provided and that are fitted with protrusions 23 formed in holder 20. By fitting protrusions 23 with fitting holes 15 at three positions as shown in FIG. 3 and FIG. 4, holder 20 can be not only prevented from moving in second electrode 12 but also prevented from disengaged from second electrode 12. This can maintain a fixed distance between airtight container 10 inserted to penetration hole 21 of holder 20 and second electrode 12.

The shortest distance between airtight container 10 and second electrode 12 is in a range from 0.1 to 2.0 mm. The shortest distance of 0.1 mm or more can prevent airtight container 10 and second electrode 12 from having a part at which they are abutted to each other or a clearance therebetween. Thus, ozone for example can be prevented from being caused.

Figure 5:
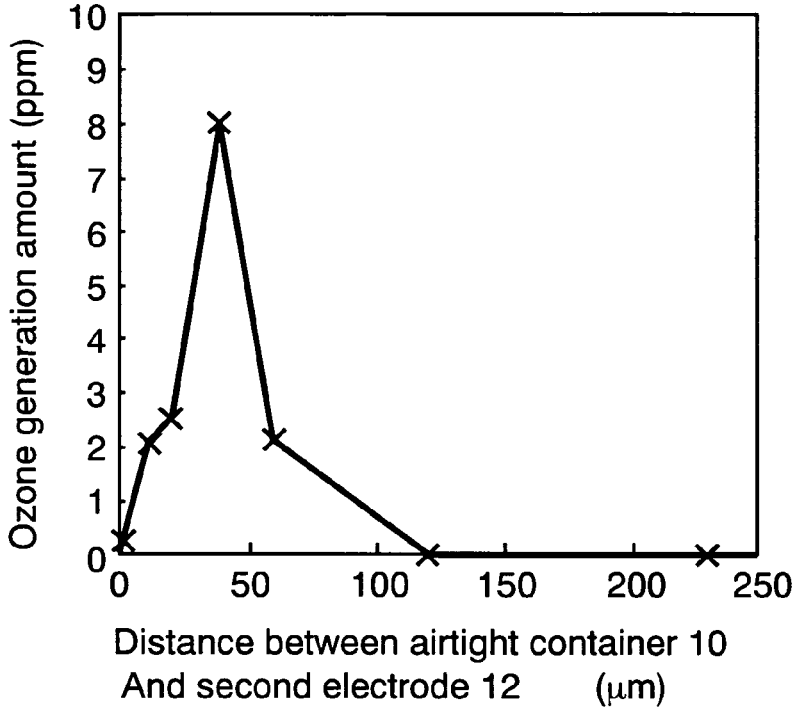
FIG. 5 illustrates a relation between an ozone generation amount and a distance between an airtight container and a second electrode.

FIG. 5 shows a result of measurement of a relation between an ozone generation amount and the shortest distance between airtight container 10 and second electrode 12. This measurement was done under typical conditions including the maximum voltage between first electrode 11 and second electrode 12 of 5 kV, a thickness of airtight container 10 of 0.1 mm, an inner diameter of airtight container 10 of 2.0 mm, discharge medium of Xe—Ar mixed gas (ratio of Xe:Ar=7:3), a gas pressure of 10 kPa, and airtight container 10 made of borosilicate glass having a dielectric constant of about 5.8. As shown in FIG. 5, no ozone is generated at all when the shortest distance is 0.1 mm or more. It was confirmed that the ozone generation amount in this measurement was below a threshold of a measuring instrument.

However, when the shortest distance between airtight container 10 and second electrode 12 is excessively long, the discharge medium in airtight container 10 cannot be sufficiently excited. Thus, this shortest distance should be 2.0 mm or less when the maximum voltage between the electrodes is 5 kV.

Airtight container 10 and second electrode 12 generally have therebetween air. An experiment showed that, when air exists between airtight container 10 and second electrode 12, dielectric breakdown is not influenced by the inner diameter of airtight container 10 (1.0 mm to 10 mm), the type of the discharge medium, the inner pressure of airtight container 10, or the shape of airtight container 10. It was also found that that dielectric breakdown is more easily caused when the thinner thickness airtight container 10 has and the higher maximum voltage the electrodes have therebetween.

Figure 6:
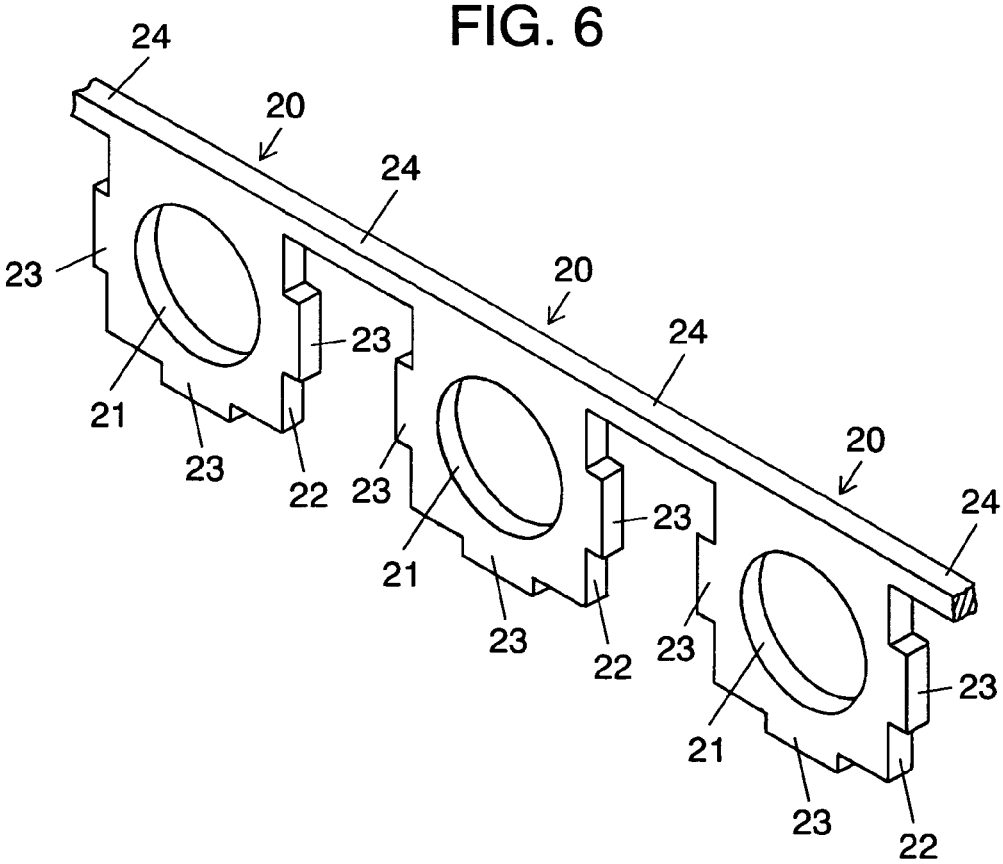
FIG. 6 is a perspective view illustrating holders of Embodiment 1 of the discharge lamp device according to the present invention arranged in parallel to one another.

The discharge lamp device having the structure as described above is used as a backlight used for a liquid crystal display for example by an arrangement in which the discharge lamp device is provided along an end face of a light guide plate (not shown) or by another arrangement in which the plurality of discharge lamp devices having the structure as described above are provided to be parallel to one another, as shown in FIG. 6, on a back face of a light guide plate (not shown). In any of these arrangements, opening 16 of second electrode 12 is opposed to the light guide plate.

When the plurality of discharge lamp devices are provided to be parallel to one another, corners of holders 20 at a side at which no second electrode 12 is provided are joined at juncture section 24. The integrated structure of holders 20 with juncture sections 24 can simplify an assembly operation. Alternatively, holder 20 also may be separately provided from juncture section 24. In this case, an arbitrary number of holders 20 can be joined.

When a lighting circuit applies voltage between first electrode 11 and second electrode 12, discharge is caused to excite a discharge medium and ultraviolet is caused when a ground state is started. This ultraviolet is converted to visible light when the ultraviolet passes through fluorescent material layer 13 and is emitted from airtight container 10. This visible light is reflected by a radiant section of second electrode 12 and is incident in a light guide plate. Then, the entire surface of the light guide plate emits light. A fixed interval between airtight container 10 and second electrode 12 is maintained by externally attaching airtight container 10 to holder 20 so that protrusions 23 formed in holder 20 are fitted with fitting holes 15 formed in second electrode 12. This prevents ozone or the like from being generated to prevent airtight container 10 from being broken. Thus, the discharge lamp device can have a longer service life.

Embodiment 2

Figure 7:
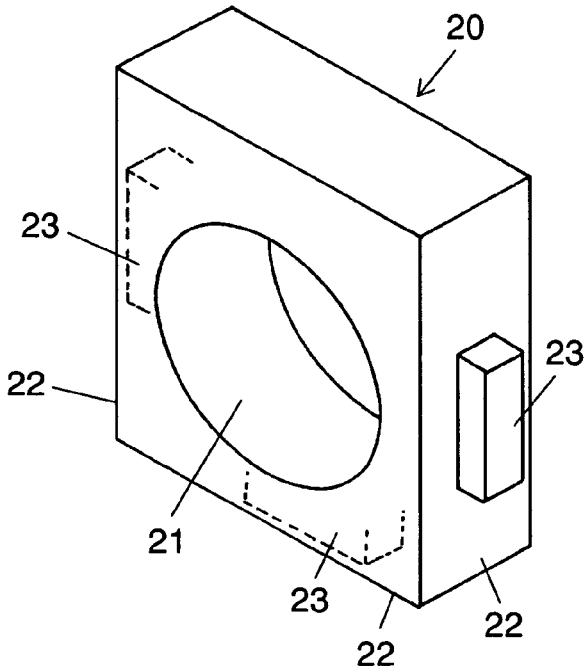
FIG. 7 is a perspective view illustrating Embodiment 2 of a holder constituting the discharge lamp device according to the present invention.
Figure 8:
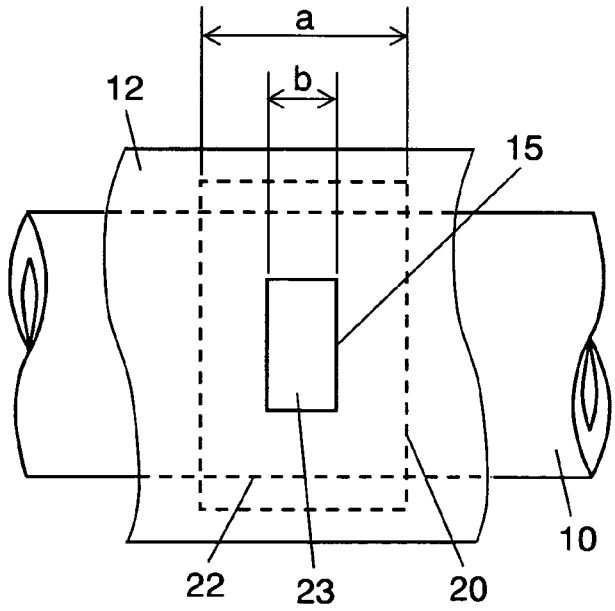
FIG. 8 is a front view illustrating the main part of Embodiment 2 of the discharge lamp device according to the present invention.

Embodiment 2 will be described with reference to FIG. 7 and FIG. 8. Embodiment 2 is characterized in that a relation between thickness a of holder 20 in a longitudinal direction of airtight container 10 and width b of protrusion 23 in the longitudinal direction of airtight container 10 is determined to be a>b. Specifically, holder 20 has a thickness that is thicker than a width of protrusion 23.

When a user holds a liquid crystal display using the discharge lamp device of the present invention as a backlight by hands, a risk may be caused where the discharge lamp device receives pressure from a side to deform holder 20 and thus a distance between airtight container 10 and second electrode 12 is changed. Another risk may be caused where dust may come into second electrode 12 via a clearance between protrusion 23 and fitting hole 15 formed in second electrode 12.

Thus, the structure according to Embodiment 2 can minimize the deformation of holder 20 even when being subjected to the pressure as described above. Thus, a fixed distance between airtight container 10 and second electrode 12 can be maintained. Furthermore, side face 22 completely sealing fitting hole 15 can prevent dust from coming into second electrode 12. Since holder 20 is formed to have a thick thickness, holder 20 is preferably made of material having a transparency from a viewpoint of improving the optical transparency. The other structures, functions and effects of Embodiment 2 are the same as those of Embodiment 1 and thus will not be further described.

Embodiment 3

Figure 9:
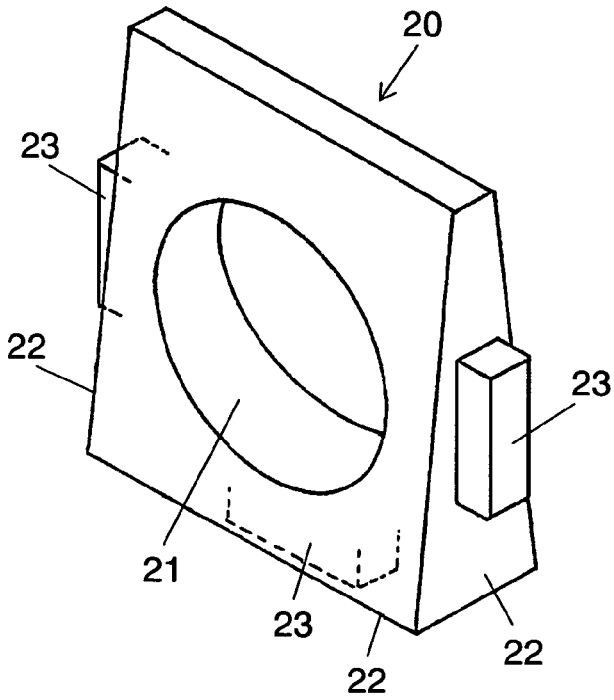
FIG. 9 is a perspective view illustrating Embodiment 3 of a holder constituting the discharge lamp device according to the present invention.
Figure 10:
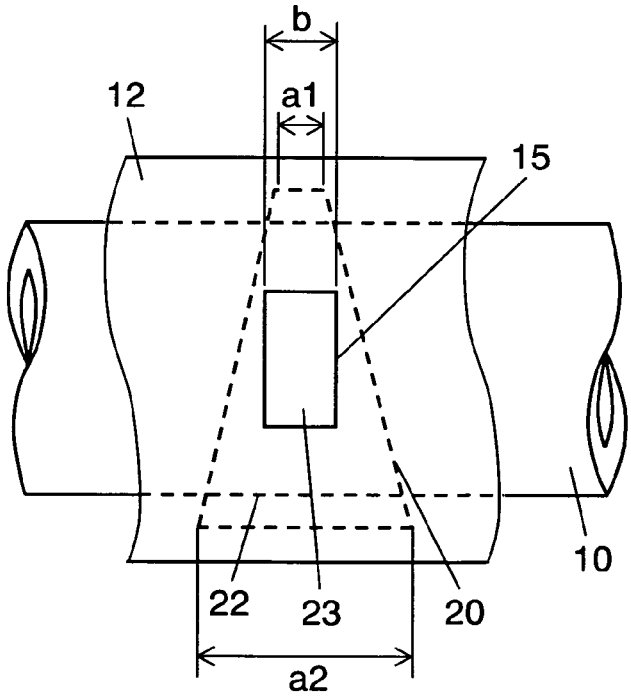
FIG. 10 is a front view illustrating the main part of Embodiment 3 of the discharge lamp device according to the present invention.

Embodiment 3 will be described with reference to FIG. 9 and FIG. 10. Embodiment 3 is characterized in that holder 20 is structured as described below. Specifically, length a of holder 20 in the longitudinal direction of airtight container 10 is determined such that a relation between length $a_1$ at a side from which airtight container 10 emits light and length $a_2$ at a side at which second electrode 12 is provided and which is opposed to opening 16 is $a_1<a_2$. Specifically, holder 20 is formed to have an almost trapezoidal shape when seen from the front and holder 20 has a thickness that is reduced in a direction along which light is emitted. A relation between $a_2$ and width b of protrusion 23 of holder 20 is determined to be $a_2>b$ from the viewpoint of securing the rigidity of holder 20. A relation between $a_1$ and b is determined to be $a_1<b$ from the viewpoint of improving the radiation efficiency of light emitted from airtight container 10.

The structure as described above provides not only the function and effect of Embodiment 2 but also forms holder 20 so that the thickness of holder 20 is increased toward a side at which second electrode 12 is provided and is reduced in a direction along which light is emitted from airtight container 10. Thus, holder 20 can have an improved rigidity while securing the light intensity of the discharge lamp device. However, the shape of holder 20 seen from the front is not limited to the trapezoidal shape and may be any shape so long as the above condition $a_1<a_2$ is satisfied. When holder 20 is made of material having a high transparency, light emitted from airtight container 10 can have a further improved radiation efficiency. The other structures, functions and effects of Embodiment 3 are the same as those of Embodiment 1 and thus will not be further described.

Embodiment 4

Figure 11:
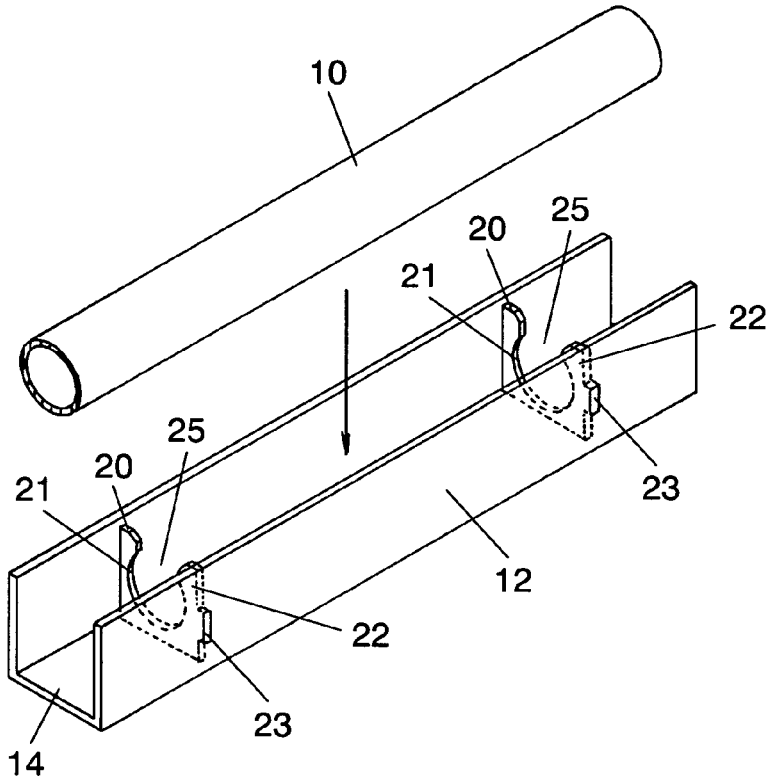
FIG. 11 is a perspective view illustrating Embodiment 4 of the discharge lamp device according to the present invention.

Embodiment 4 will be described with reference to FIG. 11. Embodiment 4 is characterized in that empty section 25 is formed at one side face 22 of holder 20. Empty section 25 is provided at a side from which light is emitted from airtight container 10 (i.e., at a side at which opening 16 of second electrode 12 is provided). Empty section 25 has a width that is smaller than an outer diameter of airtight container 10. The thickness of holder 20 may be equal to the width of protrusion 23 as shown in FIG. 4 as in Embodiment 1 or may be thicker than the width of protrusion 23 or may be reduced in a direction along which light is emitted as in Embodiment 2 and Embodiment 3.

By the above-described structure, airtight container 10 can be attached in penetration hole 21 of holder 20 while holder 20 while being attached in second electrode 12. Thus, an assembly operation is improved than that in the case of holder 20 having no empty section 25. In order to easily attach airtight container 10 into penetration hole 21 of holder 20, opposed faces of empty section 25 may be chamfered. The width of empty section 25 smaller than the outer diameter of airtight container 10 prevents airtight container 10 attached in penetration hole 21 of holder 20 from being disengaged. The other structures, functions and effects of Embodiment 4 are the same as those of Embodiment 1 and thus will not be further described.

Embodiment 5

Figure 12:
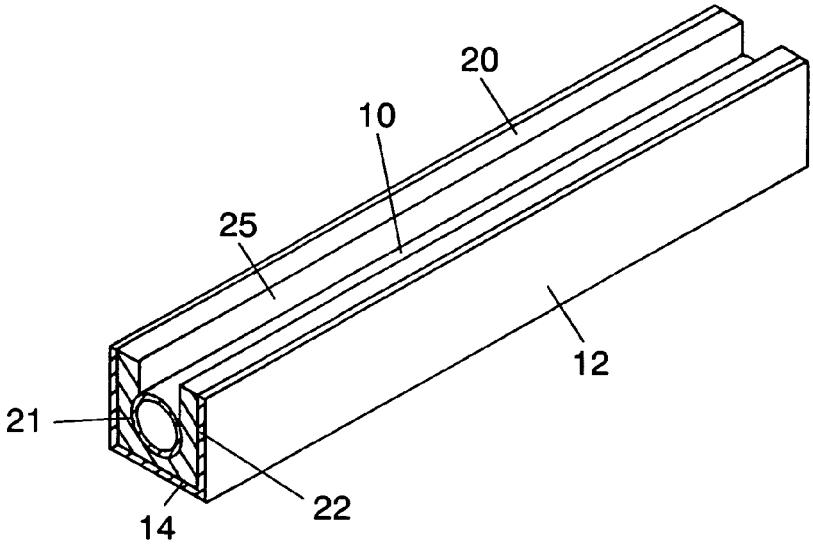
FIG. 12 is a perspective view illustrating Embodiment 5 of the discharge lamp device according to the present invention.

Embodiment 5 will be described with reference to FIG. 12. Embodiment 5 is characterized in that holder 20 having a rectangular column-like shape is formed to have the same length as that of airtight container 10 and the center of holder 20 has penetration hole 21 to which airtight container 10 is inserted. As in Embodiment 4, one side face 22 of holder 20 includes empty section 25 having a width smaller than the outer diameter of airtight container 10. Three side faces 22 of holder 20 at which no empty section 25 is formed are covered by second electrode 12 as a U-like groove. However, second electrode 12 also may have a stripe-like shape adhered to a surface opposite to empty section 25. The above-described structure allows airtight container 10 to be inserted to penetration hole 21 of holder 20 so that a fixed interval between airtight container 10 and second electrode 12 adhered to holder 20 can be securely maintained.

As in Embodiment 1, Embodiment 5 may provide protrusion 23 at side face 22 of holder 20 and may provide second electrode 12 with fitting hole 15 to which protrusion 23 is attached. Furthermore, Embodiment 5 also may arrange holders 20 so as to be parallel to one another so that corners of holder 20 may be connected by linkage member 24. Although empty section 25 is not always required, empty section 25 is preferably provided because empty section 25 facilitates an operation for attaching airtight container 10 into holder 20 extending in an axial direction. The other structures, functions and effects of Embodiment 5 are the same as those of Embodiment 1 and thus will not be further described.

Embodiment 6

Figure 13:
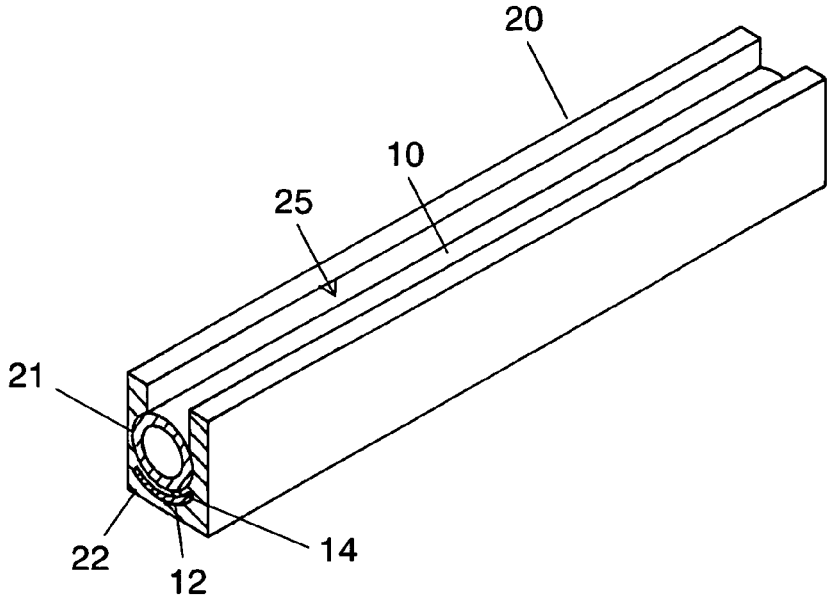
FIG. 13 is a perspective view illustrating Embodiment 6 of the discharge lamp device according to the present invention.

Embodiment 6 will be described with reference to FIG. 13. As in Embodiment 5, Embodiment 6 is characterized in that the center of rectangular column-like holder 20 having almost the same length as that of airtight container 10 has penetration hole 21 to which airtight container 10 is inserted and that one side face 22 has empty section 25 that has a width smaller than the outer diameter of airtight container 10. However, Embodiment 6 is different from Embodiment 5 in that second electrode 12 is buried in holder 20 at a side at which no empty section 25 is formed. By burying second electrode 12 in holder 20, an interval between airtight container 10 and second electrode 12 is maintained to be shorter than in the case of Embodiment 5 and second electrode 12 can be prevented from being disengaged from holder 20. In addition to the shown groove-like shape, second electrode 12 also may have a stripe-shape.

As in Embodiment 1, Embodiment 6 also may arrange discharge lamp devices to be parallel to one another so that corners of holder 20 may be connected by linkage member 24. Empty section 25 is not always required. The other structures, functions and effects of Embodiment 6 are the same as those of Embodiment 5 and thus will not be further described.

Embodiment 7

Figure 14:
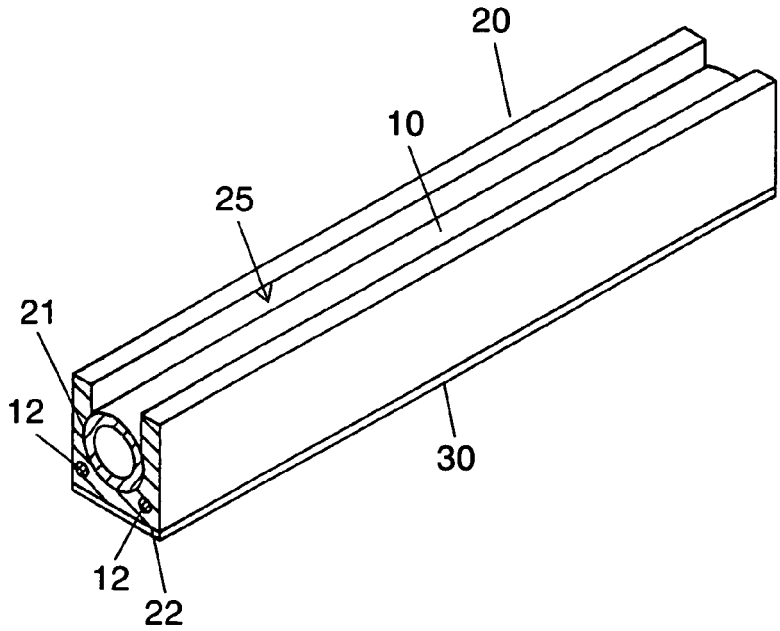
FIG. 14 is a perspective view illustrating Embodiment 7 of the discharge lamp device according to the present invention.

Embodiment 7 will be described with reference to FIG. 14. As in Embodiment 6, Embodiment 7 is characterized in that the center of rectangular column-like holder 20 having almost the same length as that of airtight container 10 has penetration hole 21 to which airtight container 10 is inserted and that one side face 22 has empty section 25 having a width smaller than the outer diameter of airtight container 10. Embodiment 7 is also characterized in that second electrode 12 is buried in holder 20 at a side at which no empty section 25 is formed. However, Embodiment 7 is different from Embodiment 6 in that reflection member(s) 30 is/are provided at three surfaces of holder 20 at which no empty section 25 is formed or at only one surface opposite to empty section 25. Second electrode 12 is composed of one or two or more rod-like electrode wire(s). This structure can reduce the interval between second electrode 12 and airtight container 10 and can increase the interval between reflection section 14 and airtight container 10.

Second electrode 12 may be a transparent electrode mainly including tin oxide and indium oxide for example. This can prevent light emitted from airtight container 10 from being blocked by second electrode 12.

The present invention is not limited to Embodiments 1 to 7 and various modifications can be made within a scope of technical matters described in claims. For example, in addition to first electrode 11 and second electrode 12, a third electrode (not shown) for facilitating a preliminary control of discharge or start of discharge also may be provided in or out of airtight container 10. Furthermore, second electrode 12 is not limited to the U-like groove shape and also may be shaped to be a C-like groove or a V-like groove to surround airtight container 10. Holder 20 also may be shaped to correspond to the shape of second electrode 12.

INDUSTRIAL APPLICABILITY

The discharge lamp device according to the present invention prevents ozone or the like from being generated to prevent an airtight container from being broken. Thus, the discharge lamp device according to the present invention is useful as a backlight for example used for a liquid crystal display for example.

The prevention of ozone or the like is particularly advantageous because the breakage of an airtight container can be prevented and thus the discharge lamp device can have a longer life.

Furthermore, the second electrode including a reflective surface can allow the discharge lamp device to have smaller size and reduced cost. Thus, a liquid crystal display including this discharge lamp device for example also can have smaller size and reduced cost.

The invention claimed is:

1. A discharge lamp device comprising:

an airtight container filled with a discharge medium mainly including noble gas;

a first electrode provided in the airtight container;

a second electrode that includes an opening through which light emitted from the airtight container is emitted, that is provided to have a predetermined interval to the airtight container, and that includes a reflective surface; and at least one insulating holder that is externally attached to the airtight container and that maintains the predetermined interval, wherein the at least one insulating holder includes a through hole to which the airtight container is inserted and the second electrode is fitted with the at least one insulating holder.

2. The discharge lamp device according to claim 1, wherein:

a length a of the at least one insulating holder in a direction along which the airtight container is inserted is determined such that a relation between length a1 at a side from which the airtight container emits light and length a2 at a side at which the second electrode is provided is a1<a2.

3. The discharge lamp device according to claim 1, wherein:

the at least one insulating holder is made of transparent material and is formed to have the same length as that of the airtight container.

4. The discharge lamp device according to claim 3, wherein:

the second electrode is buried in the at least one insulating holder to have a predetermined interval to the airtight container.

5. The discharge lamp device according to claim 1, wherein:

said at least one insulating holder includes a plurality of holders, the plurality of holders are arranged to be parallel to one another and corners at a side at which light emitted from the airtight container is emitted are joined.

6. The discharge lamp device according to claim 1, wherein:

the at least one insulating holder includes an empty section that is provided at a side at which light emitted from the airtight container is emitted and that has a width smaller than an outer diameter of the airtight container.

7. The discharge lamp device according to claim 1, wherein:

the predetermined interval is in a range from 0.1 mm to 2.0 mm at the shortest.

8. The discharge lamp device according to claim 1, wherein:

the discharge medium includes at least xenon gas and a fluorescent material layer is layered on an inner circumference of the airtight container.

9. The discharge lamp device according to claim 1, wherein:

the at least one insulating holder includes a protrusion at a position at which the second electrode is provided; and the second electrode includes a fining hole fitted with the protrusion of the at least one insulating holder.

10. The discharge lamp device according to claim 9, wherein:

a relation between a length a of the at least one insulating holder in a direction along which the airtight container is inserted and a length b of the protrusion in the insertion direction is determined to be a>b.

11. The discharge lamp device according to claim 1, wherein the at least one insulating holder completely surrounds a longitudinal axis of the airtight container.

12. A discharge lamp device comprising:

an airtight container filled with a discharge medium mainly including noble gas;

a first electrode provided in the airtight container;

at least one insulating holder that includes a through hole to which the airtight container is inserted;

a second electrode buried in the at least one insulating holder to have a predetermined interval to the airtight container; and a reflection member that includes an opening through which light emitted from the airtight container is emitted and that is externally provided to the second electrode.

13. The discharge lamp device according to claim 12, wherein:

said at least one insulating holder includes a plurality of insulating holders, the plurality of insulating holders are arranged to be parallel to one another and corners at a side at which light emitted from the airtight container is emitted are joined.

14. The discharge lamp device according to claim 12, wherein:

the at least one insulating holder includes an empty section that is provided at a side at which light emitted from the airtight container is emitted and that has a width smaller than an outer diameter of the airtight container.

15. The discharge lamp device according to claim 12, wherein:

the predetermined interval is in a range from 0.1 mm to 2.0 mm at the shortest.

16. The discharge lamp device according to claim 12, wherein:

the discharge medium includes at least xenon gas and a fluorescent material layer is layered on an inner circumference of the airtight container.

17. The discharge lamp device according to claim 12, wherein the reflection member is provided at three surfaces of the at least one insulating holder at which no empty section is formed or at only one surface of the at least one insulating holder which is opposite to an empty section.

* * * * *